US005649717A

United States Patent [19]

Augustine et al.

[11] Patent Number: 5,649,717

[45] Date of Patent: Jul. 22, 1997

[54] SNOWBOARD AND METHOD OF CONSTRUCTING THE SAME

[75] Inventors: Clinton L. Augustine, 14497 Gold Hill Rd., Boulder, Colo. 80302; Steven R. Link, Silverthorne, Colo.

[73] Assignees: Clinton L. Augustine; Jessie Allison, both of Boulder, Colo.

[21] Appl. No.: 298,347

[22] Filed: Aug. 29, 1994

[51] Int. Cl.[6] ..... A63C 5/12

[52] U.S. Cl. ..... 280/610

[58] Field of Search ..... 280/610, 87.042

[56] References Cited

U.S. PATENT DOCUMENTS

| | | | |
|---|---|---|---|
| 2,184,791 | 12/1939 | Broome | 280/11.13 |
| 3,237,963 | 3/1966 | Menzer | 280/851 |
| 3,437,345 | 4/1969 | Berta | 280/11.13 |
| 3,612,556 | 10/1971 | Seawell | 280/610 |
| 3,844,576 | 10/1974 | Schultes | 280/610 |
| 3,901,522 | 8/1975 | Boehm | 280/610 |
| 3,902,732 | 9/1975 | Fosha, Jr. et al. | 280/610 |
| 4,035,000 | 7/1977 | Lacroix | 280/610 |
| 4,044,083 | 8/1977 | Howe et al. | 280/610 |
| 4,093,268 | 6/1978 | Sampson et al. | 280/610 |
| 4,165,091 | 8/1979 | Chadwick . | |
| 4,302,859 | 12/1981 | Kozminski | 9/310 E |
| 4,383,701 | 5/1983 | Hirnbock et al. | 280/610 |
| 4,753,836 | 6/1988 | Mizell | 428/71 |
| 4,902,548 | 2/1990 | Cholat-Serpoud et al. | 280/610 |
| 4,951,960 | 8/1990 | Sadler | 280/607 |
| 4,974,868 | 12/1990 | Morris | 280/609 |
| 5,186,777 | 2/1993 | Perenon et al. | 280/610 |

FOREIGN PATENT DOCUMENTS

| | | | |
|---|---|---|---|
| 2606289 | 5/1988 | France | 280/610 |

*Primary Examiner*—Brian L. Johnson
*Assistant Examiner*—Peter C. English
*Attorney, Agent, or Firm*—Steven C. Petersen; Chrisman, Bynum & Johnson, P.C.

[57] ABSTRACT

The present invention relates to a snowboard and method of making the same using a heavy cloth material thereby eliminating some toxic materials completely and decreasing the use of other hazardous materials substantially. The snowboard constructed from the present material maintains a stiffness underfoot and a flexibility in the tip and tail to absorb bumps and irregularities in the terrain.

6 Claims, 2 Drawing Sheets

SNOWBOARD AND METHOD OF CONSTRUCTING THE SAME

BACKGROUND OF THE INVENTION

1. Field of the Invention

The present invention relates to a snowboard and more particularly to a snowboard constructed from materials that are not dangerous to handle or dispose of, while also increasing vibrational damping, flexibility and thus performance of the final product.

2. Description of the State of Art

From the early beginnings of barely-controllable foot sleds the modem sport of snowboarding has evolved into a sport requiring precision-designed snowboards which rival the controllability of much narrower downhill snow skis. While snowboard manufacturers have adapted much of the technology utilized in ski construction for the construction of snowboards; ultimately, snowboards don't look like skis and they are not ridden like skis. It is this fundamental difference that has led to a technical free-for-all throughout the industry in an effort to solve some unique problems posed by the sideways stance, whether it be regular (left foot forward) or goofy (right foot forward). The feet play an active role in snowboard performance, just as they do in skiing, however the biomechanics are completely different. Since snowboarders' feet are positioned so that they are relatively parallel to each other across a single platform, riders can work their feet and knees against each other, manipulating the torsional flex for quicker reaction, firmer edge pressure, and greater control through the turn. Thus, making the core area between the feet crucial to the performance of the snowboard.

Two distinct lines of snowboards first appeared on the market, Alpine and Freestyle. The Alpine boards are best for carving turns while traversing a hardpacked slope and through gates; however, they have limitations in bumps and powder. Freestyle boards on the other hand, while not performing as well in turns as an Alpine board, are more versatile and forgiving. Over the last couple of years a third type of snowboard or an asymmetrical freestyle snowboard has evolved. The asymmetrical freestyle board was designed to combine the flexibility of a symmetrical freestyle board with the turning ability of an asymmetrical Alpine board.

A variety of materials such as wood, metal and foam have been used in conjunction with fiberglass in an attempt to achieve a snowboard that is stiffer underfoot and more flexible in the tip and tail to aid in the absorption of bumps and other terrain irregularities. A cross sectional view of a typical snowboard 10 is shown in FIG. 1. A layer of plastic 12, such as P-Tex, is first molded into an appropriate shape for a snowboard. After plastic layer 12 has cured, reverse graphics (not shown) are usually printed on plastic layer 12. Unfortunately, the ink of choice due its adherence properties is an enamel based ink which due to its toxicity requires special handling and disposal considerations. Many snowboard manufacturers, because of the toxicity of enamel ink, ship plastic layer 12 out of the country for printing, and then import printed plastic layer 12 back into the country for final assembly. Edges 14 and 14' are next adhered to plastic layer 12 followed by a rubber foils 16 and 16' which function as cushions thus protecting edges 14 and 14', respectively. A layer of fiberglass 18 is then applied over the surface of rubber foils 16 and 16' and plastic layer 12. A veneer inset 20 is positioned within fiberglass layer 18. A stiff material such as wood, metal or foam core 22 is encapsulated with a fiberglass layer 24 thus providing a stiffer support. Metal plates or inserts (not shown) are inserted into the core so that bindings may be ultimately fastened to the snowboard. The snowboard is completed by applying a final resin or laminate layer 26 which is applied over the surface 28 of fiberglass layer 24, over the edges 30 of fiberglass layer 18, and finally over edges 32 and 32' rubber foils 16 and 16', respectively.

While snowboards constructed generally as described above perform well for the rider a disadvantage is that the large amounts of fiberglass utilized during construction of the snowboard is a safety concern which requires the use of respirators in order to avoid the inhalation of glass fibers. A further disadvantage to the snowboards discussed above and for that matter a pervasive problem throughout the entire ski industry is the use of enamel inks. Not only are enamel inks highly toxic requiring special handling and disposal considerations, but glues do not adhere as well to enamel inks as they do to the plastics which the inks are printed on. Thus, increasing the probability of the layers pulling away from one another.

There is still a need, therefore, for a snowboard which is constructed from materials which are safer to handle and dispose of while at the same time not sacrificing the performance capabilities of the snowboard.

SUMMARY OF THE INVENTION

Accordingly, it is an object of this invention to decrease or eliminate many hazardous materials that are currently used in the construction of a snowboard.

Additional objects, advantages, and novel features of this invention shall be set forth in part in the description and examples that follow, and in part will become apparent to those skilled in the art upon examination of the following specification or may be learned by the practice of the invention. The objects and advantages of the invention may be realized and attained by means of the instrumentalities, combinations, compositions, and methods particularly pointed out in the appended claims.

To achieve the foregoing and other objects and in accordance with the purposes of the present invention, as embodied and broadly described therein, the snowboard of this invention comprises an elongated base having a top and bottom surface, a pair of coplanar edges, a tip and a tail, a core having a top and bottom surface, and a cloth material that is positioned over the top surface of the core and between the top surface of the elongated base and the bottom surface of the core.

BRIEF DESCRIPTION OF THE DRAWINGS

The accompanying drawings, which are incorporated in and form a part of the specifications, illustrate the preferred embodiments of the present invention, and together with the description serve to explain the principles of the invention.

In the Drawings.

DETAILED DESCRIPTION OF THE PREFERRED EMBODIMENT

Figure 1:
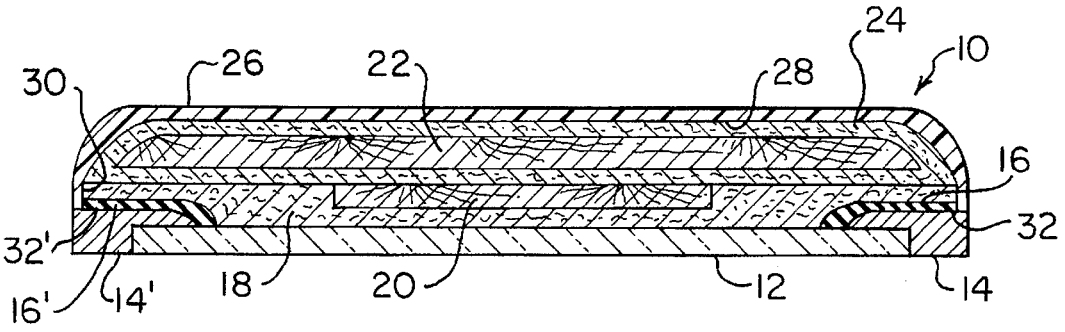
FIG. 1 (PRIOR ART)
FIG. 1 is a cross-sectional view of a typical snowboard.
Figure 2:
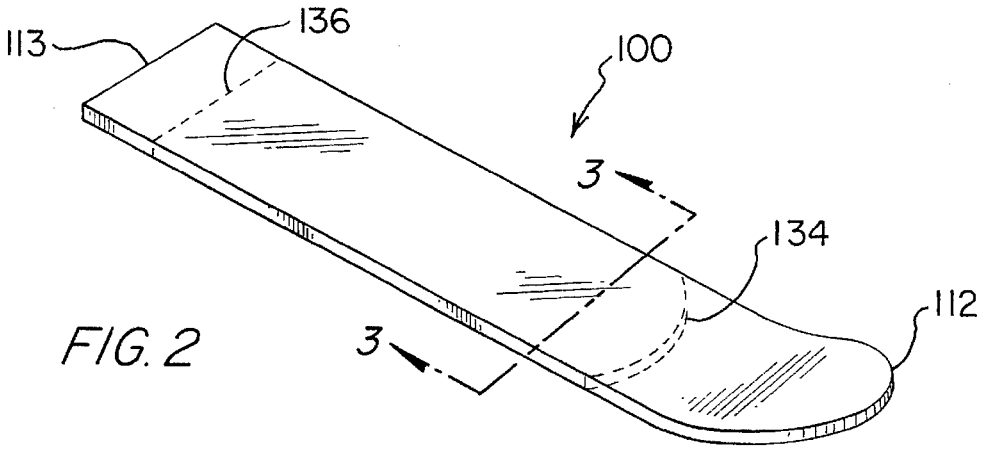
FIG. 2 is a perspective view of the snowboard constructed in accordance with the present invention.
Figure 3:
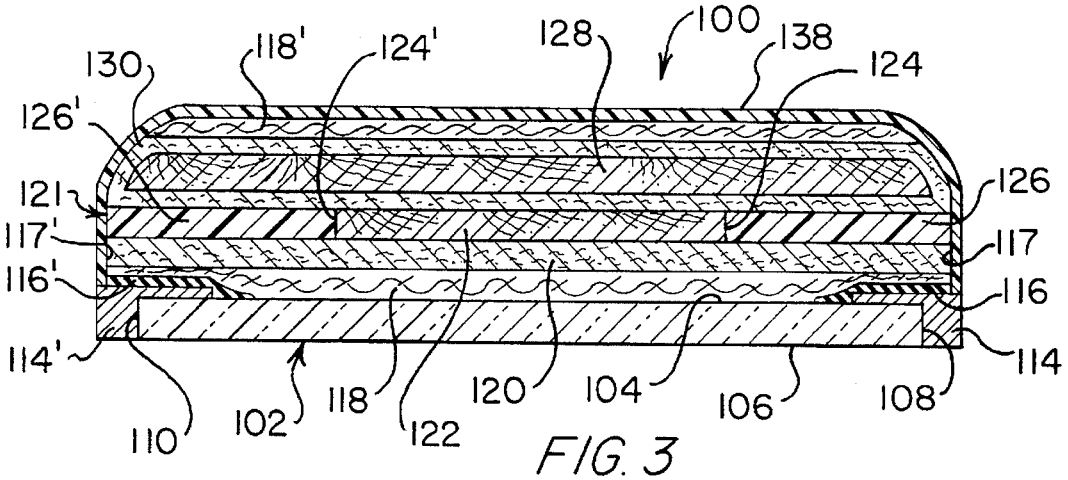
FIG. 3 is a cross-sectional view of the present invention taken along the line 3—3 of FIG. 2.

The snowboard 100, according to this invention, is shown in FIGS. 2 and 3, but is best seen as constructed in FIG. 3. Through the utilization of a cloth material, such as hemp, several significant advantages are achieved with regard to the construction and performance of snowboard 100. First, the need of printing graphics using an enamel ink is eliminated, thereby avoiding many safety concerns and costs associated with current processes, and second, the use of fiberglass is decreased and in some instances may be totally eliminated while maintaining the structural integrity and flexibility of a typical fiberglass snowboard.

The construction of snowboard 100 begins with molding an elongated base 102 having a top surface 104, a bottom surface 106, a pair of coplanar edges 108 and 110, a tip 112 and a tail 113 (shown in FIG. 2) from a plastic material, such as a high density polyethylene commonly known as P-Tex, into the form of a snowboard. The molding processes that can be used are well known to one skilled in the art and are not a part of the present invention. After the plastic material has cured, metal edges 114 and 114' are glued onto coplanar edges 108 and 110, respectively, defining the maximum width of the snowboard. Rubber foils 116 and 116' are then adhesively applied to edges 114 and 114' overlapping a portion of the elongated base surface 104. The next layer to be adhered is a layer of cloth 118, such as hemp, which is stretched out and glued to the base surface 104 and rubber foils 116 and 116'. In the event graphics or lettering is desired on snowboard 100, cloth 118 can be printed on directly using t-shirt inks or dyes or in the alternative the desired patterns could be woven into the cloth. Following the adherence of cloth layer 118, a fiberglass layer 120 is applied over cloth layer 118. A veneer panel 122 is then glued to fiberglass layer 120 leaving a border of equal distance from the veneer edges 124 and 124' to the ends 117 and 117', respectively, of fiber glass layer 120. This border area is then filled with a plastic sidewall 126 and 126' or P-Tex sidewall forming a multipiece layer 121. Surprisingly, it was discovered that sidewalls 126 and 126' function as a vibrational damping system, thus increasing the stability and edge hold at higher speeds.

The core 128 being made of wood, metal, Kevlar® or other resilient material with metal plates or inserts (not shown) is encapsulated with a layer of fiberglass 130. Metal plates (not shown) function as means for fastening bindings (not shown) to snowboard 100. The length of core 128 can be seen as phantom lines 134 and 136 (shown in FIG. 2). The tip 112 and the tail 114 are comprised mostly of fiberglass thus lending to the necessary flexibility at the ends. Following placement of the core 128 over the veneer panel 122 and sidewalls 126 and 126' a final layer of cloth material 118' may be applied, again cloth material 118' may have printed graphics. The entire exposed surface of snowboard 110 excluding the edges 114 and 114' and the bottom surface 106 are covered with an even layer of resin 138 to protect the board and inhibit moisture from penetrating the various layers.

Figure 4:
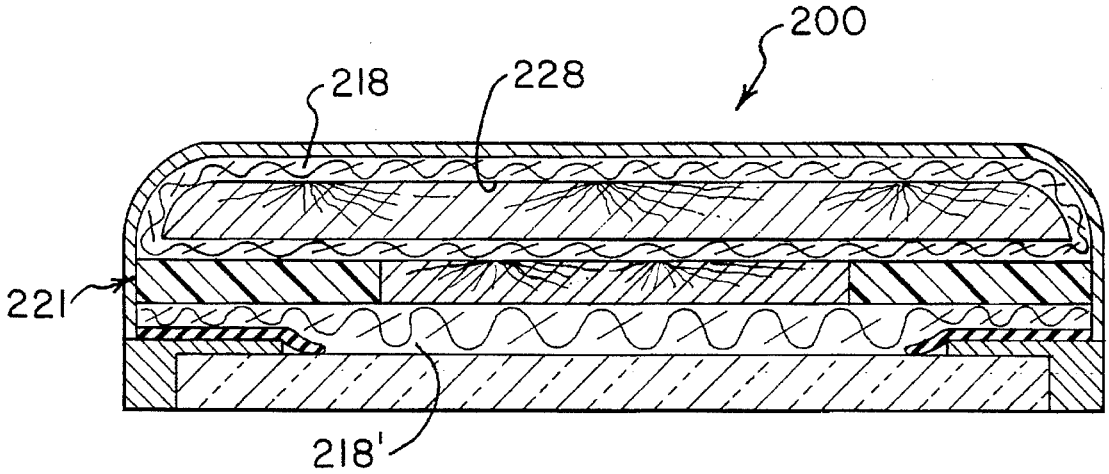
FIG. 4 is a cross-sectional view of an alternate embodiment of the present invention.

In an alternate embodiment, a snowboard 200 shown in FIG. 4 is constructed as described above, however no fiberglass is utilized. Rather than encapsulating the core 228 in fiberglass as discussed previously the core 228 is surrounded by cloth 218, glued down to the multipiece layer 221 and a cloth layer 218 is then extended out into the tip and the tail providing further support and flexibility. Finally, the assembly is coated with a resin or laminated as discussed above.

In a third embodiment any sports board, such as a skateboard, ski, surfboard etc. may be constructed so that a layer of cloth containing graphics or printed matter is exposed to the surface prior to having a protective layer of resin applied.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The embodiments of the invention in which an exclusive property or privilege is claimed are defined as follows:

1. A snowboard, comprising:

a generally flat, rigid core having a top and a bottom surface wherein said rigid core is encapsulated by fiberglass;

at least one layer of cloth material surrounding said encapsulated core;

a multipiece layer having a top surface and a bottom surface comprised of a veneer panel bordered by a plastic sidewall wherein said top surface of said multipiece layer supports said encapsulated core surrounded by said cloth;

a fiberglass layer having a top surface and a bottom surface wherein said top surface is in contact with said bottom surface of said multipiece layer;

a layer of cloth in contact with said bottom surface of said fiberglass layer; and an elongated base adjacent said cloth wherein said elongated base has a pair of edges, a tip and a tail.

2. The snowboard of claim 1, wherein said rigid core is made of wood.

3. The snowboard of claim 1, wherein said cloth is hemp.

4. A snowboard constructed from multiple layers, comprising:

an elongated base having a top surface and a bottom surface, and a tip and a tail which lie on a longitudinal axis;

a rigid core having a top surface, a bottom surface, and a length and a width wherein the width of said bottom surface is greater than the width of said top surface, and wherein said bottom surface of said rigid core is positioned parallel to said top surface of said elongated base;

at least two sidewalls positioned between said rigid core and said elongated base, wherein said sidewalls are approximately equal distance from the longitudinal axis and extend radially inward across said elongated base; and a veneer panel juxtaposed between said sidewalls.

5. A snowboard, comprising:

a generally flat, rigid core having a top and bottom surface;

at least one layer of cloth material positioned parallel to said rigid core;

a multipiece layer having a top surface and a bottom surface comprised of a veneer panel flanked by plastic sidewalls wherein said top surface of said multipiece layer supports said rigid core;

a fiberglass layer having a top surface and a bottom surface wherein said top surface is in contact with said bottom surface of said multipiece layer; and an elongated base having a lower snow engaging face and an upper face for supporting said fiberglass layer.

6. The snowboard of claim 5, wherein said cloth material is a strip of hemp.

* * * * *